US006027840A

United States Patent [19]

Yoon

[11] Patent Number: 6,027,840

[45] Date of Patent: Feb. 22, 2000

[54] SOLUTION FOR MAKING PHOTOCONDUCTIVE LAYERS IN CRTS

[75] Inventor: Sang Youl Yoon, Kyungsangbuk-do, Rep. of Korea

[73] Assignee: Orion Electric Co., Ltd., Kyungsangbuk-do, Rep. of Korea

[21] Appl. No.: 09/117,496

[22] PCT Filed: Dec. 30, 1996

[86] PCT No.: PCT/KR96/00267

§ 371 Date: Jul. 28, 1998

§ 102(e) Date: Jul. 28, 1998

[87] PCT Pub. No.: WO98/29893

PCT Pub. Date: Jul. 9, 1998

[51] Int. Cl.[7] ..... G03G 13/06

[52] U.S. Cl. ..... 430/28; 430/70; 430/77; 252/501.1

[58] Field of Search ..... 430/77, 28, 23, 430/70

[56] References Cited

U.S. PATENT DOCUMENTS

| | | | |
|---|---|---|---|
| 3,189,447 | 6/1965 | Neugebauer et al. | 430/77 |
| 3,287,120 | 11/1966 | Hoegl | 430/77 |
| 3,841,871 | 10/1974 | Blanchette | 430/70 |
| 5,405,722 | 4/1995 | Datta et al. | 430/28 |
| 5,413,885 | 5/1995 | Datta et al. | 430/28 |
| 5,501,928 | 3/1996 | Datta et al. | 430/28 |

*Primary Examiner*—Christopher D. Rodee
*Attorney, Agent, or Firm*—Notaro & Michalos P.C.

[57] ABSTRACT

Disclosed is a solution for forming photoconductive layer for electrophotographically manufacturing a luminescent screen on an interior surface of a faceplate panel for a CRT. The solution consists of 0.01 to 10% by weight of bis dimethyl phenyl diphenyl butatriene, 1 to 30% by weight of polystyrene, 30 to 100% by weight of 2,5-bis(4-diethyl aminophenyl)-1,3,4-oxadiazole, against 100% by weight of polystyrene and the remainder of solvent. The photoconductive layer manufactured using the solution facilitates performing all the processes in a visible light environment with safety in work operations, because the solution contains 2,5-bis(4-diethyl aminophenyl)-1,3,4-oxadiazole, instead of trinitro fluorenone(TNF) of cancer-causing material, as ultraviolet-sensitive material.

3 Claims, 2 Drawing Sheets

SOLUTION FOR MAKING PHOTOCONDUCTIVE LAYERS IN CRTS

FIELD OF THE INVENTION

The present invention relates to a solution for making a photoconductive layer and a method of electrophotographically manufacturing a viewing screen for a cathode ray tube(CRT) using the solution, and more particularly to a photoconductive solution which does not cause cancer and facilitates performing all the processes under a visible light environment with safety in work operations.

BACKGROUND OF THE INVENTION

Referring to FIG. 1, a color CRT 10 generally comprises an evacuated glass envelope consisting of a panel 12, a funnel 13 sealed to the panel 12 and a tubular neck 14 connected by the funnel 13, an electron gun 11 centrally mounted within the neck 14 and a shadow mask 16 removably mounted to a sidewall of the panel 12. A three color phosphor screen is formed on the inner surface of a display window or faceplate 18 of the panel 12.

The electron gun 11 generates three electron beams 19*a* or 19*b*, said beams being directed along convergent paths through the shadow mask 16 to the screen 20 by means of several lenses of the gun and a high positive voltage applied through an anode button 15 and being deflected by a deflection yoke 17 so as to scan over the screen 20 through apertures or slits 16*a* formed in the shadow mask 16.

In the color CRT 10, the phosphor screen 20, as shown in FIG. 2, comprises an array of three phosphor elements R, G and B of three different emission colors arranged in a cyclic order of a predetermined structure of multiple-stripe or multiple-dot shape and a matrix of light-absorptive material surrounding the phosphor elements R, G and B.

A thin film of aluminum 22 overlies the screen 20 in order to provide a means for applying the uniform potential applied through the anode button 15 to the screen 20, increase the brightness of the phosphor screen and prevent from degrading ions in the phosphor screen and decreasing the potential of the phosphor screen. And also, a film of resin such as lacquer(not shown) may be applied between the aluminum thin film 22 and the phosphor screen to enhance the flatness and reflectivity of the aluminum thin film 22.

In a photolithographic wet process, which is well known as a prior art process for forming the phosphor screen, a slurry of a photosensitive binder and phosphor particles is coated on the inner surface of the faceplate. It does not meet the higher resolution demands and requires a lot of complicated processing steps and a lot of manufacturing equipments, thereby necessitating a high cost in manufacturing the phosphor screen. And also, it discharges a large quantity of effluent such as waste water, phosphor elements, 6th chrome sensitizer, etc., with the use of a large quantity of clean water.

To solve or alleviate the above problems, the improved process of electrophotographically manufacturing the screen utilizing dry-powdered phosphor particles is developed. U.S. Pat. No. 4,921,767, issued to Datta at al. on May 1, 1990, describes one method of electrophotographically manufacturing the phosphor screen assembly using dry-powdered phosphor particles through the repetition of a series of steps represented in FIGS. 3A to 3E, as is briefly explained in the following.

Prior to the electrophotographic screening process, foreign substance is clearly removed from an inner surface of a panel by several conventional methods. Then, a conductive layer 32, as shown in FIG. 3A, is formed by conventionally coating the inner surface of the viewing faceplate 18 with a suitable conductive solution comprising an electrically conductive material which provides an electrode for an overlying photoconductive layer 34. The conductive layer 32 can be an inorganic conductive material such as tin oxide or indium oxide, or their mixture or, preferably, a volatilizable organic conductive material consisting of a polyelectrolyte commercially known as polybrene (1,5-dimethyl-1,5-diazaundecamethylene polymethobromide, hexadimethrine bromide), available from Aldrich Chemical Co., Milwaukee Wis., or another quaternary ammonium salt. The polybrene is conventionally applied to the inner surface of the viewing faceplate 18 in an aqueous solution containing about 10 percent by weight of propanol and about 10 percent by weight of a water soluble, adhesion promoting polymer such as poly(vinyl alcohol), polyacrylic acid, certain polyamide and the like, and the coated solution is dried to form the conductive layer 32 having a thickness from about 1 to 2 microns and a surface resistivity of less than about $10_8$ ohms per square unit.

The photoconductive layer 34 is formed by coating the conductive layer 32 with a photoconductive solution comprising a volatilizable organic polymeric material, a suitable photoconductive dye and a solvent. The polymeric material is an organic polymer such as polyvinyl carbazole, or an organic monomer such as n-ethyl carbazole, n-vinyl carbazole or tetraphenylbutatriene dissolved in a polymeric binder such as polymethylmethacrylate or polypropylene carbonate. The suitable dyes, which are sensitive to light in the visible spectrum, preferably from about 400 to 700 nm, include crystal violet, chloridine blue, rhodamine EG and the like. This dye is typically present in the photoconductive composition in from about 0.1 to 0.4% by weight. The solvent for the photoconductive composition is an organic such as chlorobenzene or cyclopentanone and the like which will produce as little cross contamination as possible between the layers 32 and 34. The photoconductive solution is conventionally applied to the conductive layer 32, as by spin coating, and dried to form a layer having a thickness from about 2 to 6 microns.

FIG. 3B schematically illustrates a charging step, wherein the photoconductive layer 34 overlying the conductive layer 32 is positively charged in a dark environment by a conventional positive corona discharger 36, which moves across the layer 34 and charges it within the range of +200 to +700 volts.

FIG. 3C schematically shows an exposure step, wherein the shadow mask 16 is inserted in the panel 12 and the charged photoconductor is exposed through a lens system 40 and the shadow mask 16, to the light from a xenon flash lamp 38 disposed at one position within a conventional three-in-one lighthouse. Then, the positive charges of the exposed areas are discharged through the grounded conductive layer 132 and the charges of the unexposed areas remain in the photoconductive layer 134, thus establishing a latent charge image in a predetermined array structure. Three exposures are required for forming a light-absorptive matrix with three different incident angles, respectively.

FIG. 3D schematically represents a developing step, wherein the shadow mask 16 is removed from the panel 12 and the positively or negatively charged, dry-powdered particles are expelled from the developer and deposited to one of the charged, unexposed areas and the discharged, exposed areas depending on the polarity of the charged particles due to electrical attraction or repulsion, thus one of the two areas is developed in a predetermined array pattern. The deposited particles are fixed to the photoconductive layer 34 as described hereinafter. The light-absorptive material particles for directly developing the unexposed or positively charged areas are charged negatively and the phosphor particles are positively charged for reversely developing the exposed or discharged areas. The charging of the dry-powdered particles is executed by a triboelectrical charging method using surface-treated carrier beads.

The dry-powdered particles and the surface-treated carrier beads, coated with a thin film of a suitable charge-control agent, are mixed in the developer 42. The black matrix particles or phosphor particles are negatively or positively charged by the surface-treated carrier beads depending upon the suitable charge-control agent.

FIG. 3E schematically represents a fixing step, wherein infrared radiation is used to fix the deposited particles by melting or thermally bonding the polymer component of the particles 21 to the photoconductive layer 34. Accordingly, polymers to be thermally bonded are contained in the photoconductive layer 34 and the black matrix particles or phosphor particles.

The steps of charging, exposing, developing and fixing are repeated for the black matrix particles and the three different phosphor particles. The faceplate panel 12 is baked in air at a temperature of 425 degrees centigrade, for about 30 minutes to drive off the volatilizable constituents of screen including the conductive layer 32, the photoconductive layer 34, the solvents present in both the screen structure materials and in the filming lacquer, thereby forming an screen array of light-absorptive material 21 and three phosphor elements R, G and B in FIG. 2.

The aforementioned process has one problem that it requires dark environment during performing all the steps since the photoconductive layer is sensitive to the visual light.

Also, U.S. Pat. No. 5,413,885 discloses a method of electrophotographically manufacturing the CRT screen under low intensity yellow lights of 577–597 nm using a novel photoconductive layer to solve the aforementioned problem. The photoconductive layer comprises ultraviolet-sensitive material consisting of bis dimethyl phenyl diphenyl butatriene, and one of trinitro fluorenone(TNF), ethylanthraquinone(EAQ) and their mixture.

However, the ultraviolet-sensitive material TNF is cancer-causing material and affects badly the human body.

Accordingly, it is an object of the present invention to provide a solution for making a photoconductive layer in a method of electrophotographically manufacturing a viewing screen for a cathode-ray tube(CRT), which does not cause cancer simultaneously with requiring no dark environment and facilitates performing all the processes in a visible light environment with safety in work operations.

SUMMARY OF THE INVENTION

To overcome the foregoing problem, the present invention is to provide a solution for forming photoconductive layer for electrophotographically manufacturing a luminescent screen on an interior surface of a faceplate panel for a CRT, said solution containing 2,5-bis(4-diethyl aminophenyl)-1,3,4-oxadiazole, instead of trinitrofluorenone(TNF) of cancer-causing material, as ultraviolet-sensitive material.

DETAILED DESCRIPTION OF THE PREFERRED EMBODIMENT

Figure 1:
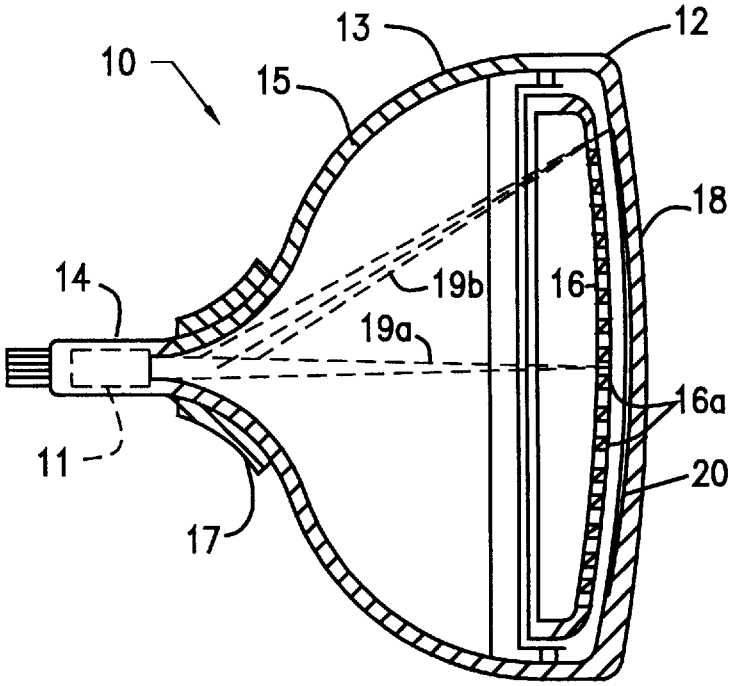
FIG. 1 is a plan view partially in axial section of a color cathode-ray tube.
Figure 2:
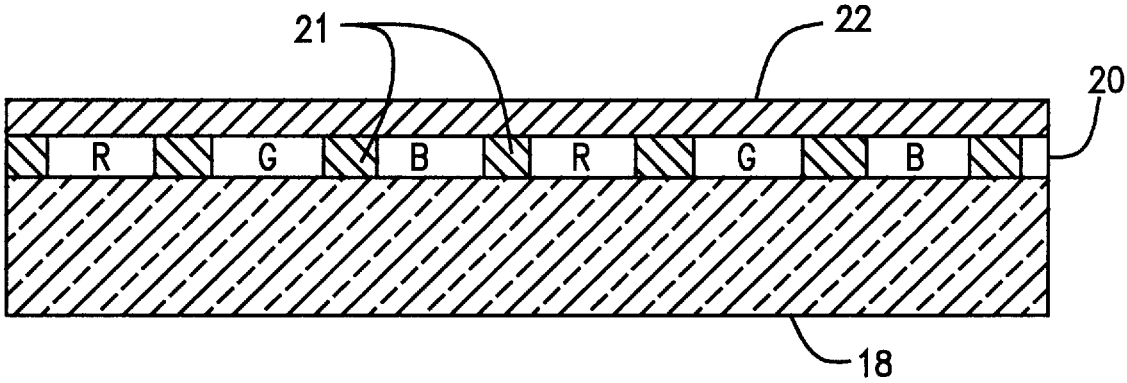
FIG. 2 is an enlarged section of a screen assembly of the tube shown in FIG. 1.

The present invention is to provide a solution for forming photoconductive layer for electrophotographically manufacturing a luminescent screen on an interior surface of a faceplate panel for a CRT comprising the steps of coating said surface of the panel with a volatilizable conductive layer and an overlying volatilizable photoconductive layer, establishing a substantially uniform electrostatic charge over the whole area of the inner surface of said photoconductive layer, exposing selected areas of said photoconductive layer to discharge the charge from the selected areas, developing one of the charged, unexposed areas and the discharged, exposed areas depending upon the polarity of the charged particles with one of charged phosphor particles and light-absorptive material particles, said solution consisting of 0.01 to 10% by weight of bis dimethyl phenyl diphenyl butatriene, 1 to 30% by weight of polystyrene, 30 to 100% by weight of 2,5-bis(4-diethyl aminophenyl)-1,3,4-oxadiazole, against 100% by weight of polystyrene and the remainder of solvent.

It is desirable that said 2,5-bis(4-diethyl aminophenyl)-1,3,4-oxadiazole be 70% by weight against 100% by weight of polystyrene.

In the solution of the present invention, 0.01 to 10% by weight of bis dimethyl phenyl diphenyl butatriene is used as one of ultraviolet-sensitive material. It is not desirable to contain said bis dimethyl phenyl diphenyl butatriene below 0.01 wt. % or above 10 wt. % because in the case of containing below 0.01 wt. % the photoconductive layer does not act as the ultraviolet-sensitive layer and in the case of over 10 wt. % foreign substance comes into being existence and is coagulated or bubble is generated on the photoconductive layer.

Said polystyrene is used as polymer binder.

In the solution of the present invention, 30 to 100% by weight of 2,5-bis(4-diethyl aminophenyl)-1,3,4-oxadiazole against 100% by weight of polystyrene is used as another ultraviolet-sensitive material, which substitutes for the forgoing trinitro fluorenone(TNF) of cancer-causing material for safe working. It is also undesirable to contain said 2,5-bis(4-diethyl aminophenyl)-1,3,4-oxadiazole below 30 wt. % or above 100 wt. % against 100% by weight of polystyrene because in the case of containing below 30 wt. %, the photoconductive layer does not act as the ultraviolet-sensitive layer and in the case of over 100 wt. % foreign substance comes into existence and is coagulated or bubble is generated on the photoconductive layer.

Said solvent for dissolving the polymer binder is selected from benzene, benzene derivatives or their mixture, etc., said benzene derivatives including toluene, ethylbenzene, xylene, styrene, etc.

The aforementioned solution of the present invention is used in electrophotographically manufacturing a luminescent screen on an interior surface of a faceplate panel for a CRT as in the following.

Figure 3A:
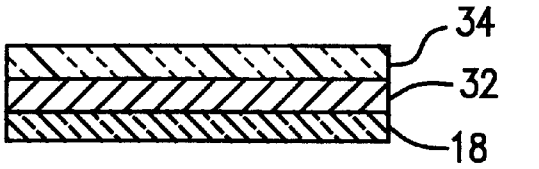
FIGS. 3A through 3E show various steps in electrophotographically manufacturing the screen assembly of the tube by viewing a portion of a faceplate having a conductive layer and an overlying photoconductive layer.
Figure 3B:
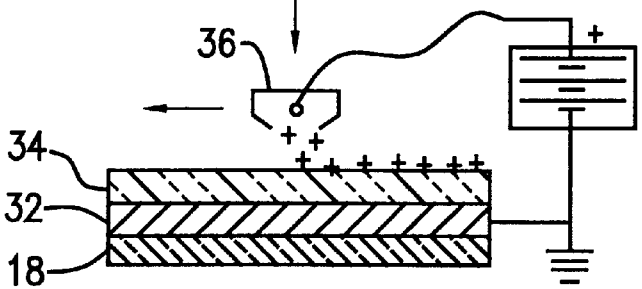
Figure 3C:
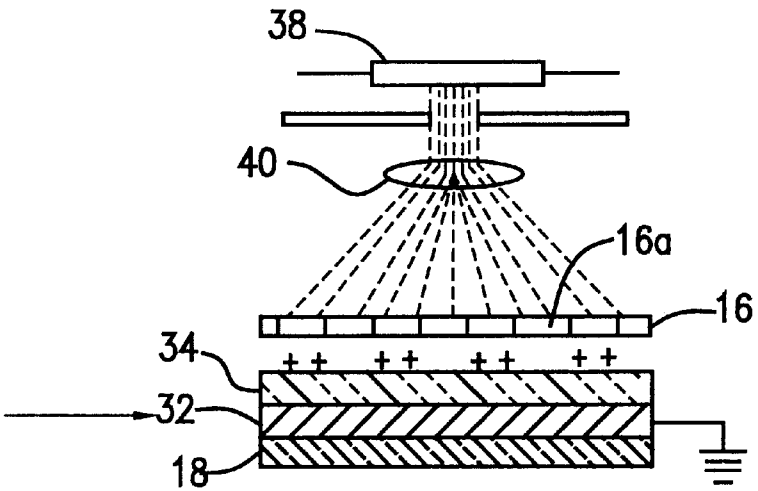
Figure 3D:
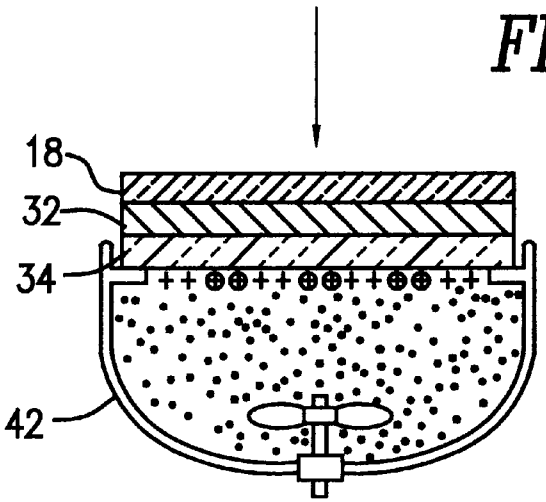
Figure 3E:
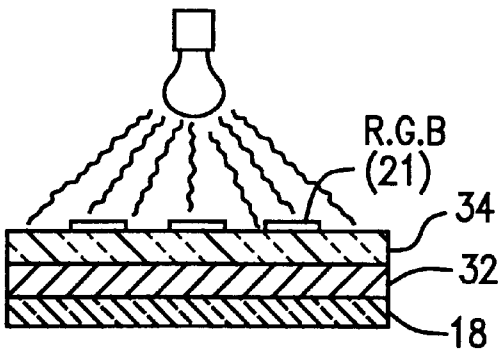

In FIG. 3A the inner surface of a panel 18 is coated with a volatilizable conductive layer 32 as described in the forgoing prior art and then with an overlying volatilizable photoconductive layer 34 using the forgoing solution of the present invention.

The photoconductive layer 34 is charged with positive electrostatic charge over the whole area of the inner surface thereof and then, said photoconductive layer is exposed in selected areas thereof to discharge the charge from the selected areas, developing one of the charged, unexposed areas and the discharged. The exposed areas are developed with charged phosphor particles and said developed phosphor particles are fixed on the photoconductive layer 34, such steps being performed under the visual light. And then the screen is formed as described in the forgoing prior art.

The aforementioned solution of the present invention, removes danger of cancer since it contains 2,5-bis(4-diethyl aminophenyl)-1,3,4-oxadiazole, instead of trinitrofluorenone(TNF) of cancer-causing material, and does require dark environment because the photoconductive materials are sensitive to ultraviolet rays only, thereby ensuring worker's safety and improvement of the working condition.

It should be clear to one skilled in the art that the present solution can be used for electrophotographically manufacturing the screen by the method as described in U.S. Pat. No. 4,921,767 and that the present process for obtaining the present solution can be modified within the scope of the present invention.

What is claimed is:

1. A solution for forming a photoconductive layer for electrophotographically manufacturing a luminescent screen on an interior surface of a faceplate panel for a CRT of a type created by coating the interior surface of the faceplate panel with a volatilizable conductive layer and an overlying volatilizable photoconductive layer, establishing a substantially uniform electrostatic charge over the whole area of the inner surface of the photoconductive layer, exposing selected areas of the of the photoconductive layer to discharge the charge from the selected areas, developing one of the charged, unexposed areas and the discharged, exposed areas with one of charged phosphor particles and light-absorptive material particles, depending upon the polarity of the charged particles, the solution consisting of:

0.01 to 10% by weight of bis dimethyl phenyl diphenyl butatriene;

1 to 30% by weight of polystyrene;

30 to 100% by weight of 2,5-bis(4-diethyl aminophenyl)-1,3,4-oxadiazole based on 100% by weight of polystyrene; and the remainder being a solvent.

2. The solution according to claim 1, wherein the 2,5-bis (4-diethyl aminophenyl)-1,3,4-oxydiazole is 70% by weight based on 100% by weight of polystyrene.

3. A method of electrophotographically manufacturing a luminescent screen on an interior surface of a faceplate panel for a CRT, the method comprising:

coating the interior surface of the faceplate panel with a volatilizable conductive layer and an overlying volatilizable photoconductive layer, the overlying volatilizable photoconductive layer being formed by applying and then drying a solution having 0.01 to 10% by weight of bis dimethyl phenyl diphenyl butatriene, 1 to 30% by weight of polystyrene, 30 to 100% by weight of 2,5-bis(4-diethyl aminophenyl)-1,3,4-oxadiazole based on 100% by weight of polystyrene, and the remainder being a solvent;

establishing a substantially uniform electrostatic charge over the whole area of the inner surface of the photoconductive layer;

exposing selected areas of the of the photoconductive layer to discharge the charge from the selected areas; and developing one of the charged, unexposed areas and the discharged, exposed areas with one of charged phosphor particles and light-absorptive material particles, depending upon the polarity of the charged particles.

* * * * *